US008193117B2

(12) United States Patent
Stalder

(10) Patent No.: US 8,193,117 B2
(45) Date of Patent: Jun. 5, 2012

(54) CARRIER PAPER

(75) Inventor: Patrick Stalder, Adligenswil (CH)

(73) Assignee: Papierfabriken Cham-Tenero AG, Cham (CH)

( * ) Notice: Subject to any disclaimer, the term of this patent is extended or adjusted under 35 U.S.C. 154(b) by 591 days.

(21) Appl. No.: 12/373,251

(22) PCT Filed: Jun. 13, 2007

(86) PCT No.: PCT/EP2007/005191

§ 371 (c)(1),
(2), (4) Date: Jul. 10, 2009

(87) PCT Pub. No.: WO2008/006434

PCT Pub. Date: Jan. 17, 2008

(65) Prior Publication Data

US 2010/0166986 A1 Jul. 1, 2010

(30) Foreign Application Priority Data

Jul. 12, 2006 (EP) ..... 06014445

(51) Int. Cl.
*B41M 5/035* (2006.01)
*B41M 5/50* (2006.01)

(52) U.S. Cl. ..... 503/227; 428/32.51

(58) Field of Classification Search ..... None
See application file for complete search history.

(56) References Cited

U.S. PATENT DOCUMENTS

| | | | | |
|---|---|---|---|---|
| 4,865,914 | A | 9/1989 | Malhotra | |
| 5,080,717 | A | 1/1992 | Young | |
| 5,354,424 | A | 10/1994 | Rha et al. | |
| 6,030,443 | A | 2/2000 | Bock et al. | |
| 6,740,622 | B2 * | 5/2004 | Eto et al. | 503/227 |
| 2005/0186363 | A1 | 8/2005 | de Visser et al. | |
| 2005/0191425 | A1 | 9/2005 | Burdick | |

FOREIGN PATENT DOCUMENTS

| | | | |
|---|---|---|---|
| EP | 0947350 | A1 | 10/1999 |
| EP | 1270662 | A2 | 1/2003 |
| EP | 1323863 | A1 | 7/2003 |
| EP | 1340621 | A2 | 9/2003 |

* cited by examiner

*Primary Examiner* — Bruce H Hess
(74) *Attorney, Agent, or Firm* — Price Heneveld LLP

(57) ABSTRACT

A carrier paper has a coating applied thereon, which serves to take up ink which is then applied using a thermal sublimation printing process to a textile or a coated hard substrate. The textile, the hard substrate coating, or both are made from a polyester-containing plastic. The coating on the carrier paper comprises a semisynthetic polymer and the coated carrier paper is placed in direct contact with the textile or with the coated hard substrate during sublimation transfer. In the case of such a carrier paper, it is intended according to some aspects of the present invention that the semisynthetic polymer has thermoplastic properties. In the case of such a carrier paper, ghosting can be permanently avoided without adversely affecting primary parameters, such as printability, drying and transfer property of the carrier paper.

6 Claims, No Drawings

CARRIER PAPER

The invention relates to a carrier paper having a coating applied thereon for taking up ink, which ink is then applied using a thermal sublimation printing process to either a textile or a coating on a hard substrate. The textile, the hard substrate coating, or both are made from a polyester-containing plastic. The coating on the carrier paper comprises a semisynthetic polymer, and the carrier paper is placed in direct contact with the textile or with the hard substrate coating during sublimation transfer from the carrier paper to the textile or hard substrate coating.

BACKGROUND OF THE INVENTION

The principle of the thermal sublimation process consists in transferring the printed image applied to a carrier paper to a suitable substrate by means of high temperature.

The print is produced, for example, using thermal sublimation inks specially provided for this purpose. These inks are applied to the coated carrier paper, for example in the inkjet printing process. On a flatbed or rotary press, the printed image is detached by means of high temperature from the carrier paper, which is in direct contact with the textile or hard substrate. The pigmented inks are converted directly from the solid to the gaseous state (sublimation) and become anchored in the textile or hard substrate.

The sublimation process (vapour phase) is problematic since the separation of carrier paper and substrate can cause ghosting produced by the residual heat. In the transfer process, the use of commercially available carrier papers therefore always results in a certain proportion of production waste, which is associated with high costs.

The adhesive sprays (consisting of styrene acrylate) available on the transfer market provide a remedy but can be only partially applied and, apart from additional costs, result in an increased production outlay. In addition, lower transfer rates have to be expected in certain circumstances as a result of the increased ink retention power of styrene acrylate.

Known synthetic thermoplastics, such as polyvinyl acetate (PVAC), polyethylene (PE), polyamide (PA), polyester (PES), polypropylene (PP), polyvinyl chloride (PVC), polyacrylonitrile (PAN) or polyacrylates, were applied as an additional coating in the case of other transfer papers known on the market, with a function analogous to that of the adhesive spray. However, these synthetic thermoplastics are to be considered as being of low quality, in particular because of the disadvantageous high ink retention power.

The possibility of incorporating synthetic polymers directly into the transfer coating is also unsuccessful since the ink retention power and the printability are very adversely affected by the thermoplastic polymer fraction required in the formulation.

A carrier paper having a coating applied thereon, according to the type mentioned at the outset, is disclosed in US 2005/0186363 A1. The coating applied in the case of this carrier paper preferably consists of carboxymethylcellulose (CMC), alginates and gelatin or mixtures thereof. However, a disadvantage in the case of CMC is that it is not a thermoplastic. Furthermore, starch ethers are used in transfer coatings.

Papers for printing in the inkjet process which are provided with a coating which comprises cellulose constituents are disclosed in EP 1 340 621 A1, EP 0 947 350 A1 and U.S. Pat. No. 4,865,914 A. The coatings are not intended for application in the thermal sublimation process for a textile or a coating of a main substrate.

Papers which are provided with a coating which comprises cellulose constituents are in principle disclosed in EP 1 270 662 A2, EP 1 323 863 A1, U.S. Pat. Nos. 5,080,717 A, 5,654,424 A, 6,030,443 A and US 2005/0191425 A1.

SUMMARY OF THE INVENTION

It is an object of the present invention to further develop a carrier paper of the type mentioned at the outset so that ghosting can be permanently avoided therewith, without adversely affecting primary parameters, such as printability, drying and transfer properties of the carrier paper.

The object is achieved in the case of a carrier paper of the type mentioned at the outset if the semisynthetic polymer has thermoplastic properties.

DESCRITION OF THE PREFERRED EMBODIMENTS

According to a further development of the invention, the semisynthetic polymer is ethylcellulose, in particular ethylcellulose having a high degree of etherification, thermoplastic starch (TPS®), methylhydroxypropylcellulose (MHPC). The semisynthetic polymer is preferably hydroxypropylcellulose.

The polymer according to the invention makes it possible to integrate the thermoplastic properties, i.e. the adhesion between the carrier paper and textile or coating of the hard substrate, directly into the coating of the carrier paper in the sublimation process. Softening of the transfer coating takes place at the high temperature. Easy adhesive bonding between the carrier paper and the substrate is thus ensured, with the result that ghosting is avoided. The semisynthetic polymers mentioned fulfill the above-mentioned properties very well. They very closely resemble the polymer carboxymethylcellulose (CMC) frequently used in coatings of thermal transfer papers in their properties since the quality-relevant parameters are not adversely affected.

It is regarded as being particularly advantageous if the coating of the transfer paper comprises from 5 to 60% by weight, in particular from 5 to 25% by weight, of the semisynthetic polymer.

The textile and the coated hard substrate do not consist completely of polyester. The hard substrate is, for example, a metal or a ceramic. The hard substrate coating is applied, for example, in the manner of a finish to the hard substrate.

The invention claimed is:

1. A sublimation transfer system, comprising:

a carrier paper;

a carrier paper coating disposed on at least one side of the carrier paper; and an image comprised of thermal sublimation ink applied to the coated side of the coated carrier paper; wherein the carrier paper coating comprises a semisynthetic polymer having thermoplastic properties.

2. The sublimation transfer system as claimed in claim 1, wherein the semisynthetic polymer is ethylcellulose, thermoplastic starch (TPS®), or methylhydroxypropylcellulose (MHPC).

3. The sublimation transfer system as claimed in claim 1, wherein the semisynthetic polymer is hydroxypropylcellulose (HPC).

4. The sublimation transfer system as claimed in claim 3, wherein the carrier paper coating comprises from 5 to 60% by weight of semisynthetic polymer.

5. The sublimation transfer system as claimed in claim 1, wherein the carrier paper coating comprises from 5 to 60% by weight of semisynthetic polymer.

6. The sublimation transfer system as claimed in claim 1, wherein the semisynthetic polymer is ethylcellulose having a high degree of etherification.

* * * * *

UNITED STATES PATENT AND TRADEMARK OFFICE

CERTIFICATE OF CORRECTION

PATENT NO. : 8,193,117 B2
APPLICATION NO. : 12/373251
DATED : June 5, 2012
INVENTOR(S) : Patrick Stalder It is certified that error appears in the above-identified patent and that said Letters Patent is hereby corrected as shown below:

Column 2

Claim 4, line 54, “claim 3” should be --claim 1--.

Claim 5, line 57, “claim 1” should be --claim 3--.

Signed and Sealed this
Fourteenth Day of August, 2012

David J. Kappos

David J. Kappos
*Director of the United States Patent and Trademark Office*